US008066334B2

(12) United States Patent
Paul et al.

(10) Patent No.: US 8,066,334 B2
(45) Date of Patent: Nov. 29, 2011

(54) TOOL FOR CUTTING COKE AND OTHER HARD MATERIALS IN DRUMS

(75) Inventors: Wolfgang Paul, Hamburg (DE); Kay Simon, Iserlohn (DE); Thomas Graefenstein, Dortmund (DE); Steffen Krenzer, Bochum (DE)

(73) Assignee: Ruhrpumpen GmbH, Witten (DE)

( * ) Notice: Subject to any disclaimer, the term of this patent is extended or adjusted under 35 U.S.C. 154(b) by 266 days.

(21) Appl. No.: 12/504,984

(22) Filed: Jul. 17, 2009

(65) Prior Publication Data

US 2011/0011648 A1 Jan. 20, 2011

(51) Int. Cl.
*B05B 1/16* (2006.01)

(52) U.S. Cl. ..... 299/29; 299/17; 175/56

(58) Field of Classification Search ..... 175/67; 299/81.2, 29, 17; 251/56; 239/443
See application file for complete search history.

(56) References Cited

U.S. PATENT DOCUMENTS

| | | | | |
|---|---|---|---|---|
| 4,850,440 | A * | 7/1989 | Smet | 175/67 |
| 5,816,505 | A * | 10/1998 | Tran et al. | 239/443 |
| 6,263,984 | B1 * | 7/2001 | Buckman, Sr. | 175/67 |
| 6,644,567 | B1 * | 11/2003 | Adams et al. | 239/447 |
| 2008/0067858 | A1 | 3/2008 | Paul et al. | |
| 2008/0271766 | A1 | 11/2008 | Paul et al. | |

FOREIGN PATENT DOCUMENTS

| | | | |
|---|---|---|---|
| SU | 1059883 | A1 | 2/1985 |
| WO | 2005/105953 | A1 | 11/2005 |

* cited by examiner

*Primary Examiner* — John Kreck
(74) *Attorney, Agent, or Firm* — Luedeka, Neely & Graham, P.C.

(57) ABSTRACT

A tool used for cutting coke or other hard materials in drums, adapted for being mounted to a boring rod with which the water can be run under pressure into the tool thus that, the water can be run toward the boring and cutting nozzles, being provided with a valve mechanism that can rotate about a coupling angle for releasing and closing the flow channel ports depending on a control input, with a first coupling position of the valve mechanism for boring and another coupling position for cutting, whereby the valve mechanism can be coupled at a water pressure reduced to the coupling pressure by rotating about the coupling angle, is simplified as to construction and handling in that the valve mechanism comprises a valve body in the water intake area of the casing, which has a cylindrical shape and a section for the water flowing inside the casing, as well as being rotationally mounted and having the possibility to be lifted and lowered in a cylindrical section of the inner wall of the casing, the valve body being displaceable at working pressure to a lower position against a spring tension —depending on the preset control for the individual desired function of the tool —and on occurring the coupling pressure, under spring tension, to an upper position relative to a rotating motion of the valve body about the coupling angle.

15 Claims, 8 Drawing Sheets

TOOL FOR CUTTING COKE AND OTHER HARD MATERIALS IN DRUMS

BACKGROUND OF THE INVENTION

1. Field of the Invention

This invention relates to a tool for cutting coke and other hard materials in bins, adapted for being mounted to a rotationally actuated boring rod that can be lifted and lowered or to another similar component with which the water can be run under pressure into the tool casing, water can be run under working pressure through flow channels in the casing toward the outwardly orientated boring and cutting nozzles, being as well provided with a valve mechanism that can rotate about a coupling angle for releasing and closing the flow channel ports depending on a control input, with which, in a first boring coupling position, the flow channel ports running to the boring nozzles are released, and the flow channel ports running to the cutting nozzles are closed, while in another coupling position of the cutting valve mechanism the flow channel ports running to the cutting nozzles are released and the flow channel ports running to the boring nozzles are closed, whereby the valve mechanism can be switched from the boring function to the cutting function and conversely at a water pressure reduced to the coupling pressure, by rotating about the coupling angle.

2. Description of Related Art

In WO 2005/105953 is disclosed a tool of this kind, known as decoking tool for cutting coke. This tool displays, in a casing provided with boring and cutting nozzles, a virtually cylindrical flow body whereby there are extending four flow channels whose upper ports can be closed in pairs of two by means of two disk shaped closing bodies of a valve mechanism. The valve mechanism is mounted into a by-pass channel to which, on actuating the tool there flows water under high pressure from a boring rod, to which the tool is secured with a flange surrounding an inlet channel. On actuating the tool, the water enters the tool under high working pressure and there, in terms of the coupling position of a control device connecting a coupling device to the valve mechanism, the water is run either through the flow channels and an extension connected to them to the boring nozzles or through corresponding flow channels to the cutting nozzles, and is discharged there for boring or cutting the coke material.

To switch the tool from "boring" to "cutting" and conversely, the control device is provided as valve mechanism with a guiding device for the closing bodies. By way of this, the two closing bodies diametrically opposing each other can be optionally shifted over a pair of ports in the flow body for boring function or over another pair of ports therefrom for the cutting function. When the pair of ports for the boring function is closed through the closing bodies, the pair of ports to intake water for cutting is opened, and conversely.

For switching from boring function to cutting function the working pressure is lowered and the guiding device is rotated by 90° through a gear manually actuated from the outside as control device. In this case the gear comprises a bevel wheel driven by a corresponding bevel wheel on the upper side, which actuates the rotation of the control device of the guiding mechanism by 90° for switching the tool.

On switching the tool, using a pair of disk shaped closing bodies for closing the flow channel ports, whose nozzles are not actuated for the present function of the tool, bears beneficially upon the residual or coupling pressure, unlike the great surfaces of the valve plates in the tools described hereinafter. This is because the forces actuating the closing bodies through the coupling pressure, which occur on shifting the closing bodies by means of the guiding device, are comparatively low.

Nevertheless, the tool could be much improved by simplifying the coupling device for switching the tool from the boring to the cutting function, and vice-versa.

The object is to improve the handling of the known tool, in particular by simplifying the actuation of the guiding device and extending the application spectrum of the tool.

SUMMARY OF THE INVENTION

This object is achieved according to the invention in that the valve mechanism comprises a valve body in the water intake area of the casing, which is cylindrically shaped, and in the cylinder comprises a section for the water flow entering the casing, and is rotationally mounted, being possible to have it lifted and lowered in a cylindrical section of the inner wall of the casing, the valve body being at working pressure can be shifted against a spring tension to a lower position where, upon demand of the input control the valve mechanism switches from boring to cutting function, and on occurring the coupling pressure can be shifted under spring tension to an upper position, and the control is thus structured that each upward and downward motion of the valve body incorporates its rotating motion about the coupling angle.

Thus, according to the invention, the control actuation on switching the rotatable valve mechanism about the coupling angle is much simplified, namely relative to the alterations in the water flow entering the tool casing. The use of water flow pressure alterations for actuating the guiding devices for switching the tool, for instance from boring to cutting function, is indeed already known in principle, for instance from SU 1059883 and U.S. Pat. No. 6,644,567. However, the invention avoids the technical problems and building expenses pertaining to the known automatic controls in terms of water pressure alterations.

One of the most important benefits of the invention consists in that the component of the tool taking up the water flow feeding it and further running it by control means toward the ports and water intakes respectively, to which certain functions are assigned, is itself an important part of the control and switching device, respectively. According to the invention, the valve mechanism comprises a valve body, provided straight in the water feeding area of the casing, cylindrically shaped and rotationally mounted, being possible to have it lifted and lowered in the cylindrical upper section of the inner wall of the casing. This valve body absorbs in a section, which is open on the top, the water flow entering the casing and runs it further, relative to the adjusted coupling position, toward the boring or in another coupling position toward the cutting, in the corresponding openings of the flow channels running toward the boring and cutting nozzles, respectively. Insofar the valve body actuated by the control system due to water pressure alterations controls the water flow repartition in the flow channels that are released relative the function they were adjusted for, while the flow channel ports used relative the other functions are closed.

Further to this function of distributing the water flow to the chosen inlet channels, according to the invention the valve body takes up switching the tool, for instance from a first coupling position to boring and herefrom through another switching to another coupling position of the tool. As will be illustrated later on, contrary to the present state of the art two, three and four different coupling positions of the valve device, and therefore of the tool, are possible without any limitations in this case. As will also be exemplified later on, for each adjusted function of the tool a pair of nozzles is used, these nozzles being provided in the casing wall diametrically opposing each other. However, it is also possible to assign different functions to the two nozzles of a nozzle pair, for instance thus that one of the two nozzles cuts obliquely upward and the other nozzle cuts obliquely downward.

For each alteration of the tool function switching of the valve body from one coupling position to the other coupling position of the valve body is needed. In order to do this the valve body is rotationally mounted with the possibility to have it lifted and lowered in the upper cylindrical section of the inner wall of the casing. On lowering the water working pressure to the coupling pressure, the valve body is lifted from a lower position to an upper one through the spring tensioned under the working pressure, and is simultaneously rotated to half of the coupling angle. When the water pressure is increased again over the coupling pressure, the spring tension is overcome so that the valve body is shifted against the spring tension to a lower position, and is at the same time further rotated by another half of the coupling angle, having thus the valve body in the other desired position wherein it carries out another function. When the valve body is lowered up to its lower position by simultaneous rotation, the spring is stressed again and thus can be used to shift the valve body upward and downward when the coupling position of the tool will be changed next time. For reasons of clarity, it should be pointed out again to the fact that a complete upward and downward shift of the valve body with a rotation of this about the coupling angle is necessary in order to afford the switching from one coupling position with a certain function of the tool to another coupling position with a different function. One half of the coupling angle is assigned to the upward shifting and the other half of the coupling angle to the downward shifting of the valve body, each related to the corresponding rotation movement.

Accordingly, the invention avoids on the one hand the indispensible distribution of the functions water intake or water supply respectively, which are necessary for all known tools according to the state of the art, and on the other hand of the control for switching the tool from one function to another function to different devices, being partly separated by a considerable distance in the inside of the tool casing. In lieu thereof the two functions of the valve device, namely assigning the water flow entering the corresponding inlet channels and the function automatic switching of the tool by means of the water pressure alterations, are incorporated into a single component, namely in the valve body. Although the embodiment further detailed later on and shown in the drawings even admits three switching positions or functions of the tool, respectively, unlike other automatically switched tools, the outstandingly simple construction of the tool herein becomes apparent.

Switching the tool at a water pressure reduced to the coupling pressure is common. But according to the invention, upon switching the rotation movement of the valve body is superposed by the upward shifting followed by the downward shifting of the valve body, thus that the otherwise indispensible friction of the valve plates or the valve body respectively, is not necessary on plain rotation.

The tool according to the invention is suited as decoking tool, and besides this for cutting other hard materials, for instance catalytic materials, in conditions similar to decoking.

Preferably, on a 360° rotation of the valve body, the control comprises at least two coupling positions each corresponding to a selected operation mode of the tool. Adjusting more than two coupling positions is certainly possible, without forgoing the invention assets.

The valve body section taking up the water flow is preferably cylindrical, namely adapted to the inner space of the casing and affording the unimpeded water flow inside the valve body.

In order to afford the entering of the water flow, the valve body preferably displays ports at its lower side, of which there are opened those whereby the water flow is run through nozzles for the desired function while the other ports assigned to different functions are closed.

Preferably, referring to ports, these are provided diametrically opposite two by two, corresponding to the same functions of the tool.

As previously mentioned, the actuating force for lifting the valve body with simultaneous rotation is provided, according to the invention, by a spring. This is installed at a coaxial position relative to the longitudinal axis of the casing to be used therein as actuation means for lifting the valve body.

The spring is preferably secured with the upper end to the valve body, and with the lower end to the inner side of the casing. Thus, the upper end of the spring has to be rotationally mounted at the bottom of the valve body. This is because the spring actuates the valve body lifting during its rotation. To this object, in order to transfer the spring tension, there is used the rotational and axial mounting of the spring at the bottom of the valve body with a corresponding axial support. The lower end of the spring is rigidly mounted in the inner part of the casing and is supported there.

According to an invention development, in order to achieve an axial mounting of the upper end of the spring with a concurrent radial guidance there is provided a bore in a central boss in the bottom of the valve body where the upper end of the spring is mounted and secured.

According to an invention development, a tubular housing coaxial relative to the longitudinal axis of the casing, extending downward from the lower side of the bottom of the valve body, radially mounted as well as axially displaceable in the inner section of the casing and accommodating the helically shaped spring, is used to guide the spring on lifting and lowering the valve body. Guiding stripes are used as borders on passing from the casing lower section to the tubular housing.

A housing seat secured coaxially relative to the longitudinal axis of the casing at the inner section of the casing, and accommodating the tubular housing, is preferably used to set the tubular housing to its lower end.

According to the invention, both for the upward and downward shift of the valve body and for its rotation movement there is provided a control, preferably designed as a connecting link guide (link motion) on the outer wall of the valve body and the inner wall of the casing. This solution stands out in particular against the known control means by less room requirements, contributory to the all the way compact shape of the tool.

Preferably, the connecting link guide shows on the outer wall of the valve body a profiled groove with oblique profiled slots running zigzag over the outer wall of the valve body, where a finger of at least one sliding screw protrudes into the casing wall. The connecting link guide could be mounted conversely too, the profiled groove being worked out, for instance, on a cylindrical shaped piece on the upper side of the casing, where corresponding cams or the like engage at the outer side of the valve body. Regardless of the manner the connecting link guide control is built, on switching the tool relative to water pressure alterations to the coupling pressure, it effects concurrently with the spring the necessary lifting and lowering of the valve body, thus that both motions induce a rotating motion of the valve body about the coupling angle.

Preferably, the upper and the lower profile tips, where the profile slots converge, are each creating a return shape set opposite to the inner intersection points of the walls of the profile slots toward the relative motion of the sliding screw finger. This construction effects that the valve body rotates further toward the desired direction of rotation when lifted again from a lower position or lowered again from an upper position, the finger reaching the inner wall of that respective profile slot, which determines the desired rotating direction.

Finally it is preferred that lugs be provided on the lower side of the bottom of the valve body for accommodating caps, and a cap support bearing ports to afford the passing of the water flow and with ports to accommodate the caps.

BRIEF DESCRIPTION OF THE DRAWINGS

One embodiment of the invention is hereinafter explained with reference to the drawings. The drawings show.

DETAILED DESCRIPTION

Figure 1:
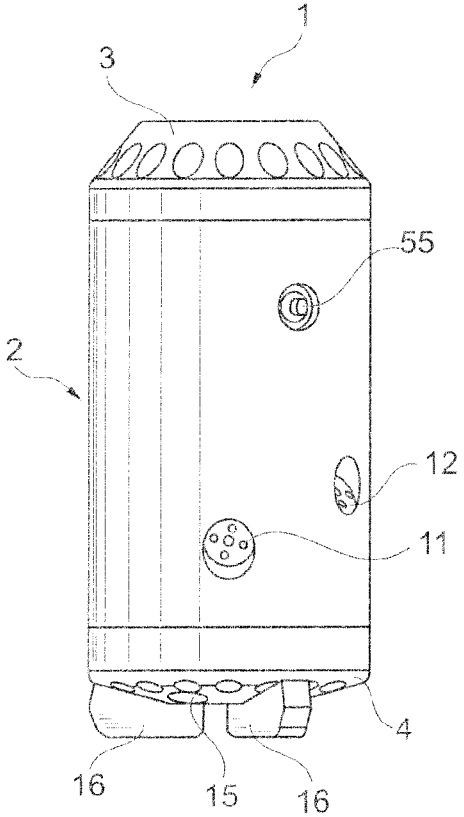
FIG. 1 a lateral view of a tool.
Figure 2:
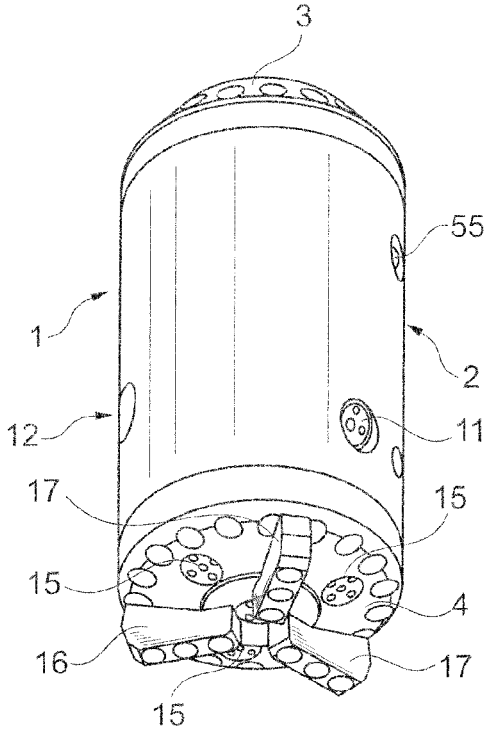
FIG. 2 a perspective view of the tool of FIG. 1 as seen obliquely from below.
Figure 3:
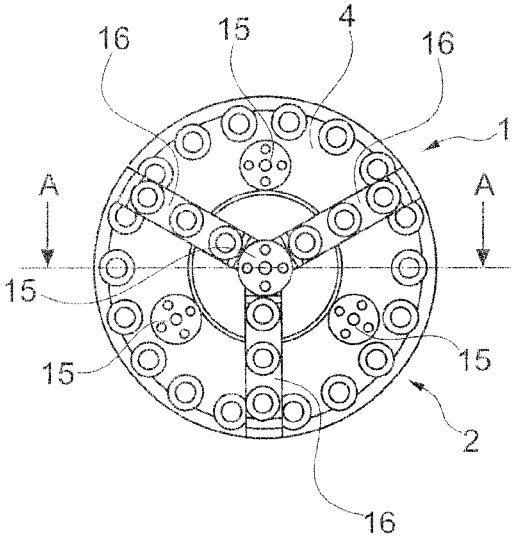
FIG. 3 a top view of the bottom side of the tool of FIGS. 1 and 2.

A tool 1, shown in FIG. 1 to 4, has a casing 2 to which upper end an upper cover 3 is screwed and to which lower end a lower cover 4 is screwed.

The tool 1 can be attached with its upper cover 3 to the lower end of a rotating boring rod, not shown, that can be lifted and lowered for boring or cutting coke or other hard materials in a cylindrical drum by means of a rotating mechanism, also not shown, and whereby water can be run in dependence of a control mechanism under high pressure through an inlet port 5 in the upper cover 3 of the casing 2 into a water flow area 6 of the tool 1. The water reaches through a valve body 7, that is rotationally installed and can be lifted and lowered in a manner to be explained later on in a cylindrical section 8 of an inner wall 9 of the casing 2, coaxial to the casing axis, and through flow channels 10 in the lower section of the casing 2 the cutting nozzles 11 obliquely directed downward or the cutting nozzles 12 obliquely directed upward (FIG. 4*b*), if a downward or upward, respectively, cutting function is preset from the control. For a boring function, the flow channels 10 are closed and the water flow reaches through the flow channels 13 (see FIG. 8) a central chamber 14 built at the lower side of the casing 2 and the upper side of the lower cover 4, and therefrom it reaches the boring nozzles 15 mounted in the lower cover 4, as shown in FIGS. 1 through 4, where the water flow is ejected by four downward directed high pressure water beams.

Three blades 16 are symmetrically attached to the bottom side of the lower cover 4, as shown in the drawing, to protect the tool 1 as well as to put away the material to be cut.

Figure 4A:
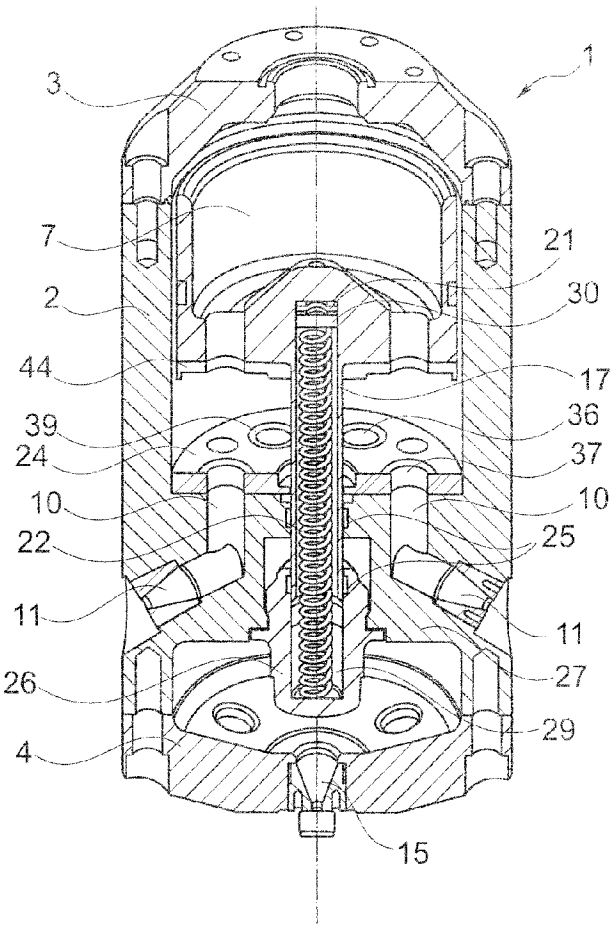
FIG. 4 a section view of the tool of FIGS. 1 through 3 along the section line A-A of FIG. 3, FIG. 4*a* a perspective section view of the tool of FIGS. 1 to 4.
FIG. 4*b* another section view of the tool of FIGS. 1 to 4 to show a middle section of the tool.
Figure 4:
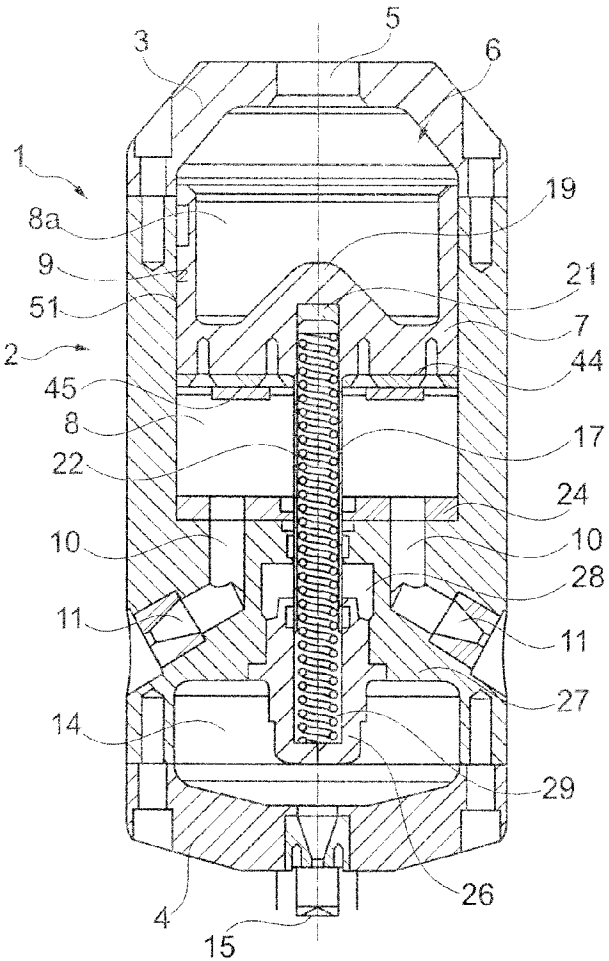
Figure 6:
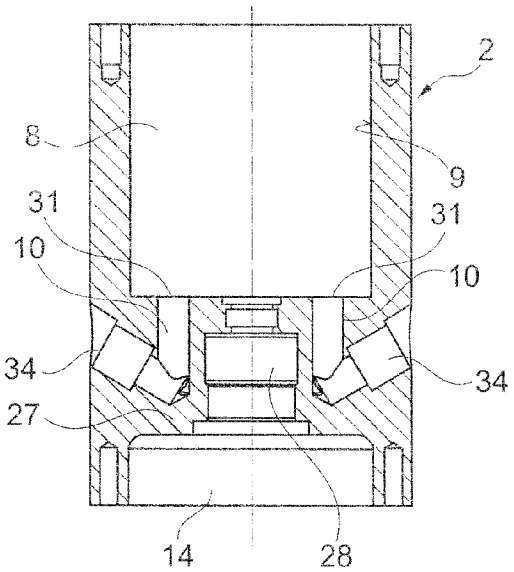
FIG. 6 a section view of the base body along the section line A-A of FIG. 5.
Figure 21:
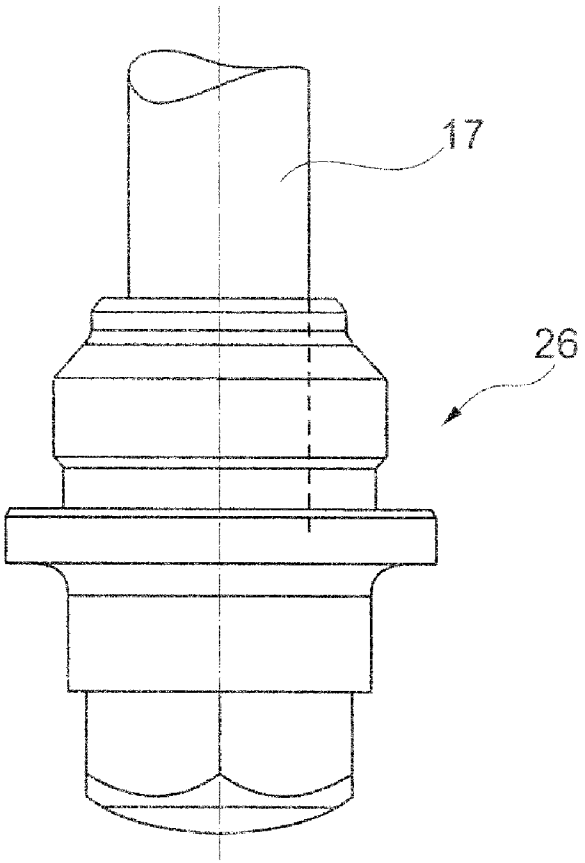
FIG. 21 a lateral view of the tool casing seat.

From FIG. 4, along with FIGS. 10 through 12 and 14, it follows that from the lower side of the valve body 7 downwardly protrudes a tubular housing 17 being open at its bottom and whose inner wall 18 extends upward to a massive central boss 19 of a bottom 20 of the valve body 7, while at the upper end it is closed with an axial support 21 for accommodating an helical spring 22 mounted in the tubular housing 17. The tubular housing 17 enters a port 23 of a flow plate 24 and extends axially in a gliding way over guiding strips 25 mounted in a casing seat 26 (see FIG. 21), which is screwed and co-axially attached from below in the casing 2, as shown in the drawing, in a port 28 of a casing component 27 (see FIGS. 4, 6-9, 21). The helical spring 22 bears with its lower end against the bottom of a central port 29 (FIG. 4*a*) of the casing seat 26, while with its upper end bears against a disk 30 connected upstream of the axial support 21. In this way, the tubular housing 17 can be rotated, lifted and lowered along with the valve body 7, if this performs a combined rotating and upward or respectively downward motion inside the cylindrical section 8 of the casing 2, while the helical spring 22 does not rotate and relative to the direction of the upward and downward motion is compressed more or less.

At working pressure, the valve body 7 is compressed against the helical spring 22 tension to a lower position (see FIG. 4*b*), and upon decreasing the water flow pressure to the so-called coupling pressure below the helical spring 22 tension is shifted to an upper position.

In FIGS. 5 through 9 is disclosed the way how the water flow can reach the cutting and boring nozzles (11,15), respectively, in the casing component 27 through the valve body 7 in the cylindrical section 8 of the casing 2.

Figure 5:
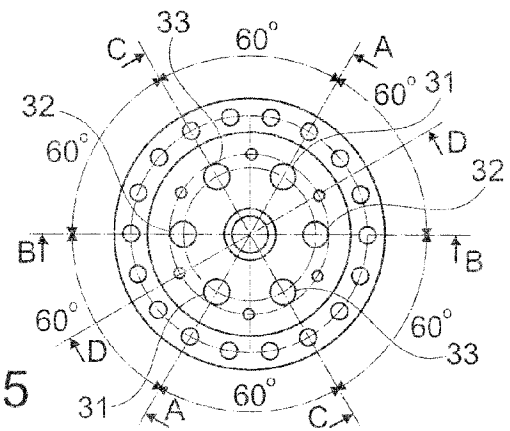
FIG. 5 a top view of a casing base body of the tool of FIGS. 1 to 4.

A pair of diametrically opposing ports 31 pertains to the flow channels 10 running downward in parallel to the axis, wherefrom there are provided below connection means obliquely bent upward toward the nozzle intakes 34, obliquely bent upward. A pair of ports 32 pertains correspondingly to the flow channels 10 (see FIG. 7), wherefrom there are provided below connection means toward the nozzle intakes 35, which are obliquely bent downward. The angular layout of the pair of ports 31, 32 and 33, respectively, is shown in FIG. 5. Therein, the section line C-C (see FIG. 8) runs through the flow channels 13 with a pair of ports 33 diametrically opposing to each other. It is important to emphasize that the connection lines of the pair of ports 31, 32, 33 and of the section lines A-A, B-B, respectively, as well of C-C, are arranged one to the other displaced at a 60° angle, the so-called coupling angle (FIG. 5).

Figure 18:
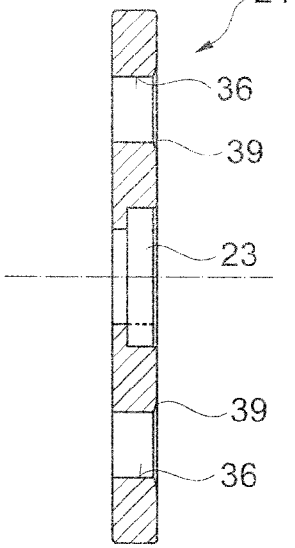
FIG. 18 a section view of the flow plate of FIG. 17 along the section line A-A of FIG. 17.
Figure 17:
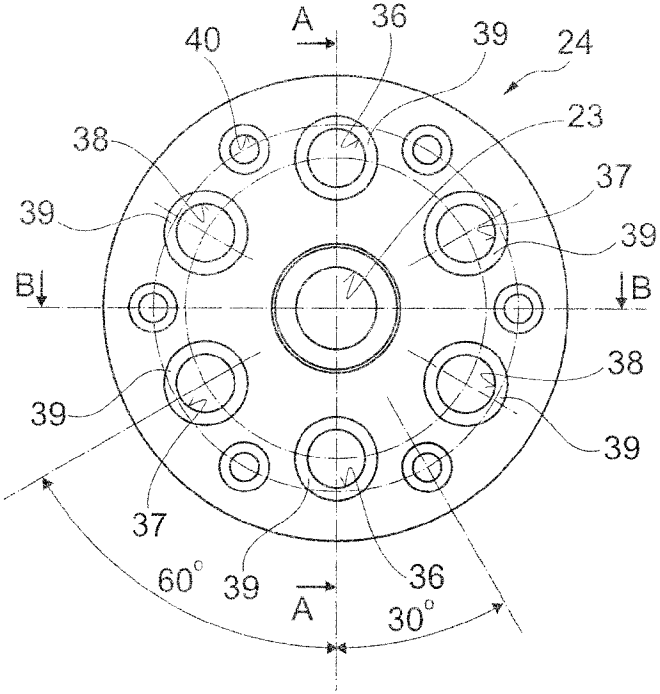
FIG. 17 a top view of a flow plate of the tool.

At the bottom of the cylindrical section 8 of the casing 2 there is attached the flow plate 24, seen in FIG. 4 but detailed in particular in FIGS. 17 and 18. This acts along with the valve body 7 to run the water flow in synchronization with the control. In a corresponding position relative to the ports 31, 32, 33, the flow plate 34 has, along with the flow channels 10 and 13, respectively, coaxial pairs of ports 36, 37, 38 which are provided on each side orientated to the valve body 7, with a chamfer 39, as shown in FIGS. 17, 18.

Figure 9:
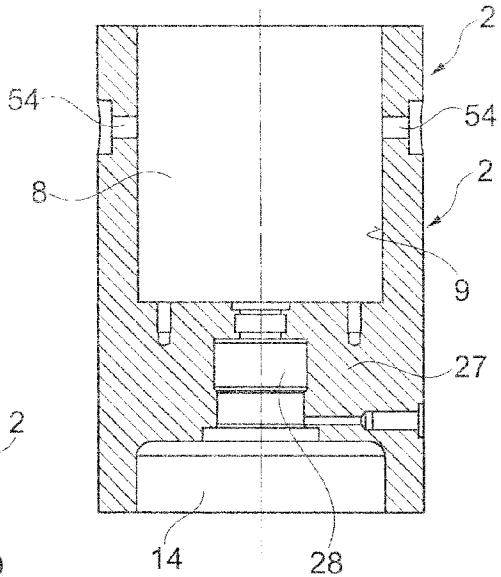
FIG. 9 another section view of the base body of FIG. 5 along the line D-D of FIG. 5.

Between the ports 36, 37, 38 of the flow plate 24, on a circle slightly laid to the outside, there are bores 40 for screwing the flow plate 24 to the bottom of the cylindrical section 8 of the casing 2 (see FIG. 9). It is important to emphasize that the ports 36, 37, 38, as already the ports 31, 32, 33 are arranged on the bottom of the cylindrical section 8 each at an angular distance of 60° one to the other. In order to afford the tubular housing 17 enter on its upward and downward motion the central port 23 is provided in the flow plate 24.

Figure 4B:
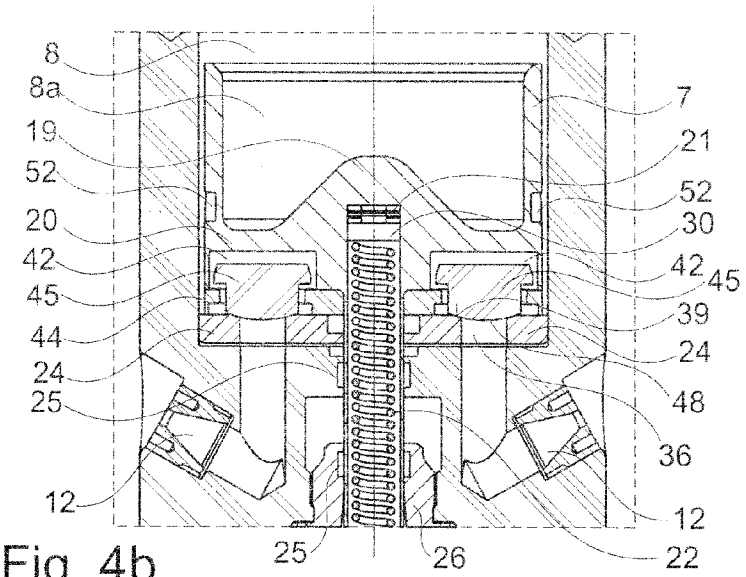
Figure 12:
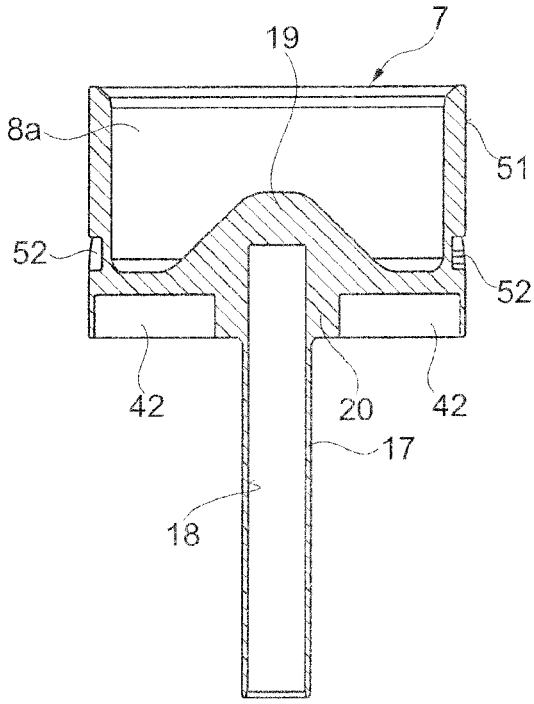
FIG. 12 a section view of the valve body of FIG. 10 along the section line A-A of FIG. 10.
Figure 11:
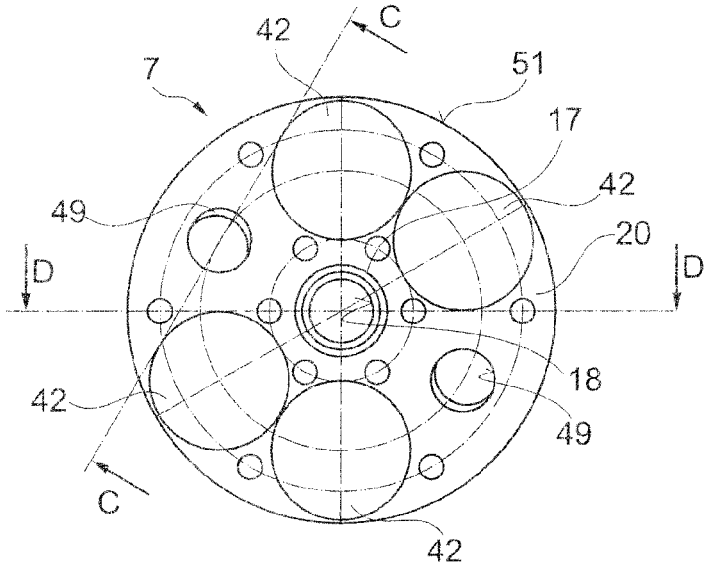
FIG. 11 a bottom view of the valve body of FIG. 10.
Figure 19:
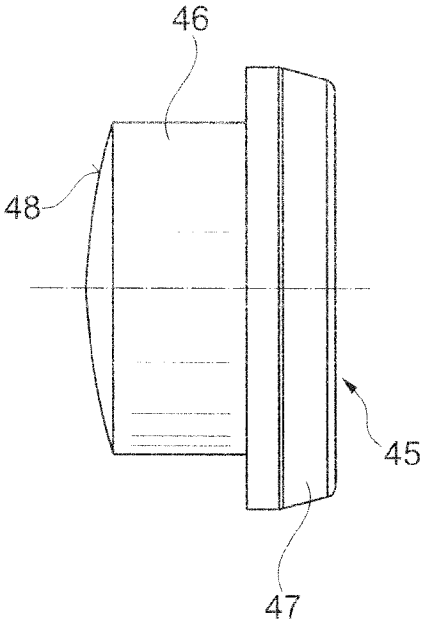
FIG. 19 a lateral view of one of the manifold caps of the tool.

On the lower side of the valve body 7 four circular cut-outs 42 are arranged as shown in FIGS. 11 and 12, as well as in FIG. 4*b*. Ports 43 align with the cut-outs 42 in a disk shaped cap support 44 (FIGS. 15, 16) that is screwed to the lower side of the valve body 7. In each of the four cut-outs 42 there is loosely inserted a cap 45 consisting of a rod 46 and a connection ring 47 (FIG. 19), as seen in FIG. 4*b*. A curvature 48, contacting the chamfer 39 of each of the ports 36, 37, 38 of the flow plate 24, as seen in FIG. 4*b*, is arranged on the lower side of the rod 46.

Figure 15:
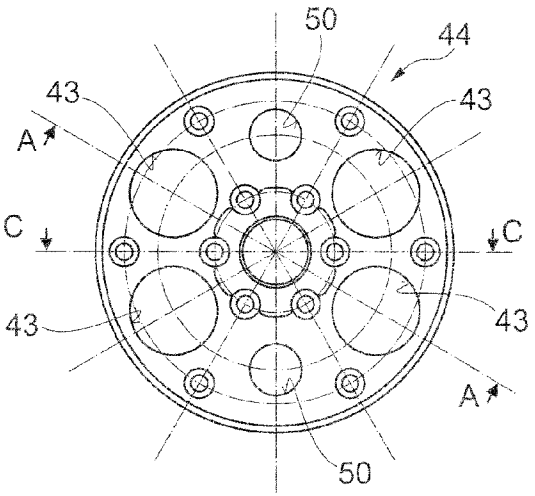
FIG. 15 a top view of a cap support of the tool.
Figure 16:
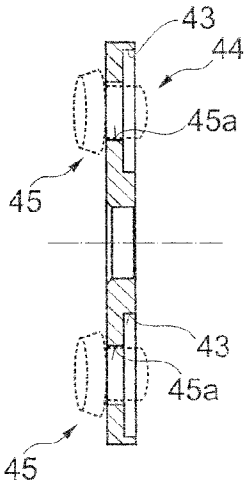
FIG. 16 a section view of the cap support of FIG. 15 along the section line A-A of FIG. 15.

In order to afford the water flowing, two diametrically opposed ports 49 laid between the four cut-outs 42 are provided on the bottom 20 of the valve body 7, thus the aligned ports 50 being in the cap support 40 (see FIG. 15).

This arrangement already shows that the four caps 45 on the bottom of the valve body 7, as shown in FIG. 4*b*, are closing two pairs of ports, for instance 36, 37, in the flow plate 24, while the third pair of ports, herein 38, is released thus that the water flow entering the inside of the valve body 7, which is open on the top, through the ports 49 (see FIGS. 11, 13) in the bottom 20 of the valve body 7, as well as through the ports 50 of the cap support 44, can run through the released ports 38 of the flow plate 24 and therefrom through the ports 31 of the flow channels 10 toward the corresponding cutting nozzles.

From the aforementioned description becomes apparent that in the chosen embodiment three coupling positions of the tool 1 are possible, namely for the functions cutting obliquely upward (see FIG. 6), cutting obliquely downward (see FIG. 7) and boring (see FIG. 8), as far as water flows under pressure to the flow channels 10 and 13, respectively, in the drawings referred to. When, for instance, the valve body 7 is in an angular position releasing the intake of the pressure water through the two ports 49 on the bottom of the valve body 7, and through the ports 50 in the cap support 44, as well as through the ports 38 in the flow plate 24, running thus the water under pressure to the flow channels 10 for the cutting nozzles 12 directed obliquely upward, the four caps 45 are closing the ports 36, 37 of the flow plate 24, thus that the water under pressure cannot reach either the flow channels 10 for the cutting nozzles 35 directed obliquely downward nor the flow channels 13 for the boring nozzles 15. Accordingly, in this coupling position the water flow takes place at the level of the section line A-A from FIG. 5, corresponding to FIG. 6.

Figure 8:
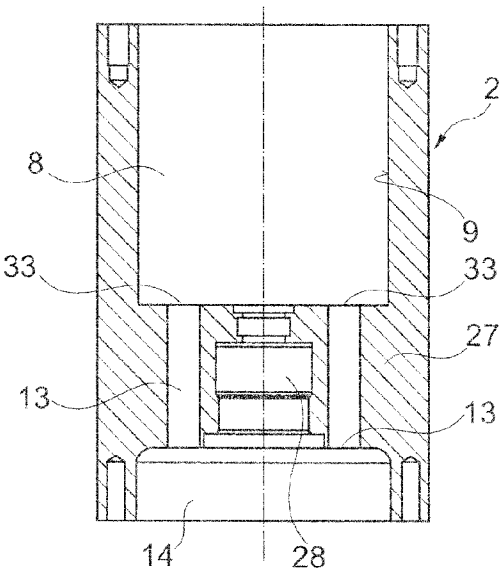
FIG. 8 another section view of the base body of FIG. 5 along the line C-C of FIG. 5.
Figure 7:
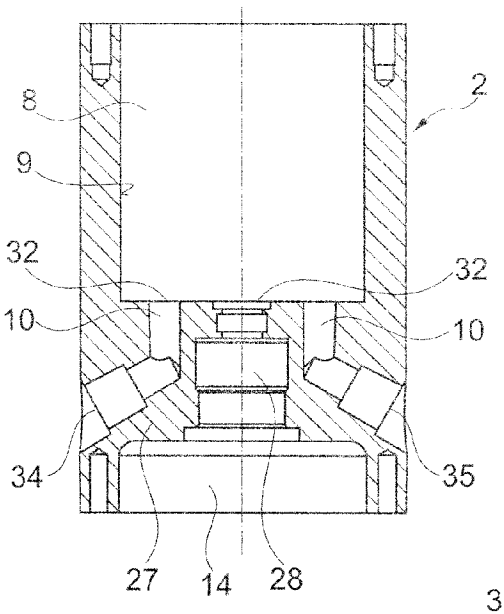
FIG. 7 another section view of the base body of FIG. 5 along the line B-B of FIG. 5.

If the switching from this first coupling position to the second coupling position, corresponding to the function cutting obliquely downward, takes place now (see FIGS. 4, 4*a*, 7), an automatic switching occurs in that the working pressure in the pressure water intake system is cut off and the water pressure in the water intake area 6 is reduced to the minimum. Once thereby a so-called coupling pressure is achieved, the valve body 7 is pushed from a lower active position, for instance, according to FIG. 4*b*, under the helical spring tension 22 upward to an upper position, for instance, according to FIG. 4*a*. Upon this upward movement, subsequently to an automatic control to be further described, a rotation of the valve body 7 by 30° occurs concurrently. Once the water pressure in the system is raised again, and the helical spring tension 22 is accordingly overcome, the valve body 7 is lowered again in the cylindrical section 8 of the casing 2, a rotating motion of the valve body 7 by 30° in the same previous direction occurring concurrently so that the angular position of the valve body 7 alters with a so-called coupling angle of 60° once this reverts to the initial position, as shown in FIG. 5 and FIG. 17. Once reverting to its lower position, the valve body 7 closes now—according to FIG. 5 further rotated clockwise by 60°—the water intake in the channels 10 with the cutting nozzles directed upward, and further thus the water flow through the flow channels 13 toward the boring nozzles 15 (FIG. 8). In lieu thereof the water flows freely through the ports 49 on the bottom 20 of the valve body 7 toward the flow channels 10, according to FIG. 7, with the cutting nozzles 11 directed obliquely downward in the nozzle intakes 35 (FIG. 7).

From FIG. 4*b* it is apparent that the respective caps 45 close with the lower curvature 39, for instance, the ports 36 seated on the annular chamfers 39, firmly adjusted under water pressure. Once the working pressure to switch the tool 1 is reduced, the caps 45 are raised off their place on the chamfers 39 by means of the cap support 44, when each of the caps 45 contacts the flow plate 24 with their connection ring 47. While lifting and lowering the valve body 7 by 30°, the caps 45 do not contact the flow plate 24 to avoid wearing them off while being shifted to the coupling angle. On reaching the next coupling position, the caps 45, lying loosely in the cut-outs 42, are seating directly over the next four ports of the flow plate 24, each time the lower curvature 48 of each caps 45 making direct contact with the corresponding annular chamfers 39.

A third coupling position can be achieved by renewing the automatic switching through reducing the working pressure relative to lifting and rotating the valve body 7 by 30°, and its final lowering and rotation by another 60°. With respect to FIG. 5, the water flows now from section line B-B to section line C-C according to FIG. 8, thus that the pressure water can penetrate toward, and through the boring nozzles 15.

Figure 10:
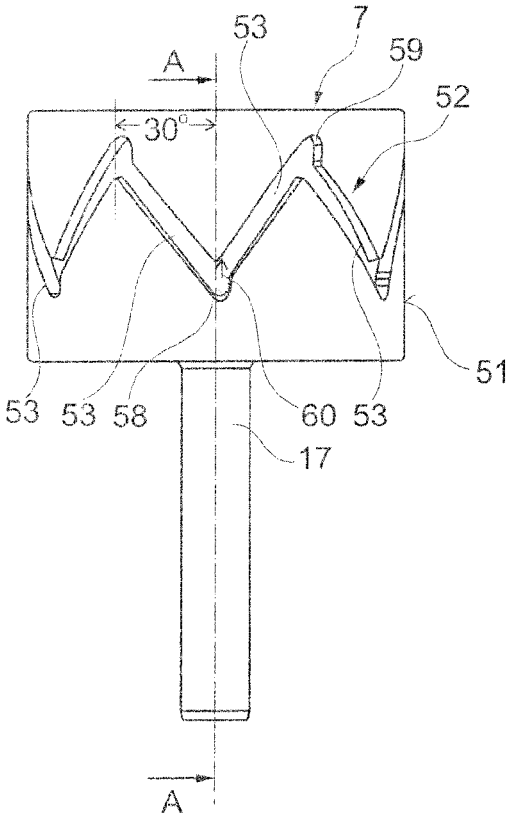
FIG. 10 a lateral view of a valve body of the tool.
Figure 20:
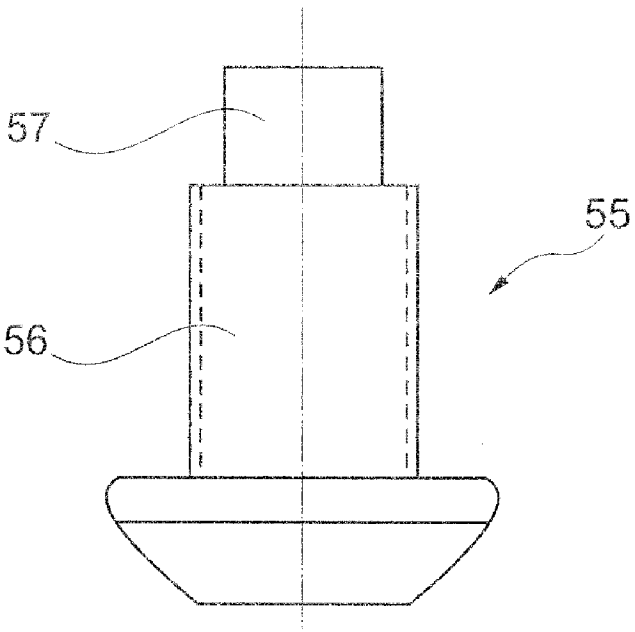
FIG. 20 a lateral view of a sliding screw of the tool.

The rotation of the valve body 7 by 30° on lifting and lowering is effected by a connecting link guide depicted in FIGS. 1, 9, 10, 4*a* and 4*b*, as well as in FIG. 20. In the outer wall 51 of the valve body 7 a zigzag shaped profiled groove 52 is carried out, as seen in FIG. 10, with profile slots 53 running obliquely relative to wall 52, slots forming a closed circle on the outer wall 51 of the valve body 7. In threaded holes 54 diametrically opposing each other (FIG. 9) a sliding screw 55

(FIG. 20) with a thread shank 56 and a soldered finger 57, preferably of bronze, is attached such that the finger makes permanently contact with a profile slot 53 of the profiled groove 52. Each of the profile slots 53 displays at its upper and lower ends profile tips 58, 59, rounded and slightly off the 30° hold point, as shown in FIG. 10. Each profile slot 53 corresponds to a half of a coupling angle of 30°. In the lower position of the valve body 7, the finger 57 of the sliding screw 55 is in the upper tip 59 of the profile and slides relatively toward the valve body 7 on its downward movement to a lower tip 58 of the profile, when the valve body 7 is in its upper position. The slightly shifting of the lower tip 58 of the profile, shown by an arrow 60 in FIG. 10, makes sure that the respective valve body 7 rotates further in the desired direction in that the finger 57 engages in the direction of the arrow 60 with the right profile slot 53—in correspondence with the drawing in FIG. 10, and in that—again in correspondence with the drawing—enters relative to the valve body 7 obliquely upward to the right up to the end of this profile slot 53 in the upper tip 59 of the profile. The connecting link guide does not require an auxiliary lubrication since the friction contact of the sliding screws 55 in the profiled groove 52 is constantly water washed.

Figure 13:
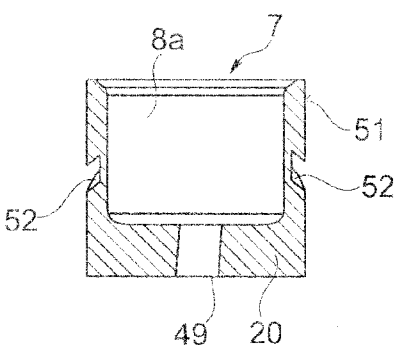
FIG. 13 a section view of the valve body of FIGS. 10 and 11 along the section line D-D of FIG. 11.
Figure 14:
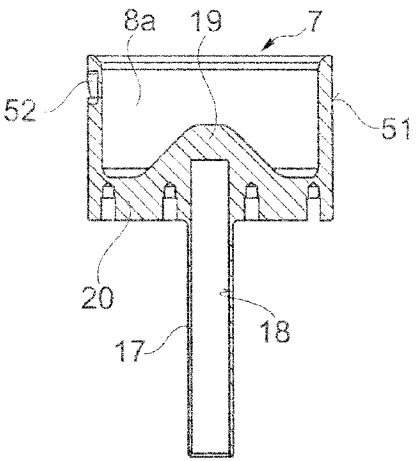
FIG. 14 a section view of the valve body of FIGS. 10 and 11 along the section line D-D of FIG. 11.

As shown in FIGS. 11 and 13, the ports 49 on the bottom 20 of the valve body 7 run obliquely in order to support the desired rotating direction of the valve body 7.

Needless to say that the connecting link guide used in this embodiment can be performed by inversing the guiding component settings, too, namely with sliding screws in the outer wall 51 of the valve body 7, and with a corresponding profiled groove having profile slots in the inner wall 9 of the casing 2. Besides, according to requirements there are possible two or more than three coupling positions, too, by correspondingly carrying out the connecting link guide and the water flow channels.

In the present embodiment the connecting link guide of the valve body 7, relative to the previously shown and described water pressure routes, affords an easy automatic switching of the tool 1 from the first to the second, and from the second to the third function, as previously shown and described. The structure of cutting and boring nozzles 11, 12, 15, similar to the necessary water pressure of the tool 1 and the dimensions of the tool 1, depends entirely on the aforementioned requirements and the material to be bored or cut.

The invention claimed is:

1. Tool for cutting coke and other hard material in drums, comprising:

a casing (2) having flow channels (10, 13) leading to outwardly oriented boring and cutting nozzles (15, 11, 12);

a valve mechanism rotatable relative to the casing about a coupling angle for releasing and closing ports (31, 32, 33) of the flow channels (10, 13), wherein in a first boring coupling position of the valve mechanism the ports (33) of the flow channels (13) running to the boring nozzles (15) are released and the ports (31, 32) of the flow channels (10) running to the cutting nozzles (11, 12) are closed, and wherein in a second cutting coupling position of the valve mechanism the ports (31, 32) of the flow channels (10) running to the cutting nozzles (11, 12) are released, and the ports (33) of the flow channels (13) running to the boring nozzles (15) are closed;

wherein the valve mechanism can be switched between the first boring coupling position and the second cutting coupling position at a water pressure reduced to a coupling pressure by rotating the valve mechanism about the coupling angle;

wherein the valve mechanism comprises a cylindrically shaped valve body (7) positioned in a water intake area (6) of the casing (2), wherein the valve body defines a section (8*a*) of the water flow path for water entering the casing (2), wherein the casing (2) has an inner wall (9) defining a cylindrical section (8) and wherein the valve body (7) can be lifted and lowered between an upper and a lower position in the cylindrical section (8), and wherein the valve body (7) is moved at working pressure, against tension from a spring (22) to the lower position wherein the valve mechanism switches to one of the boring or cutting function, and wherein at coupling pressure the valve body (7) is moved by tension from the spring to the upper position, and wherein each upward and downward motion of the valve body (7) relative to the cylindrical section (8) controls rotation of the valve body (7) about the coupling angle.

2. Tool according to claim 1, wherein the section (8*a*) to absorb the water flow of the valve body (7) is cylindrically shaped.

3. Tool according to claim 1, wherein the valve body (7) has a bottom (20) with ports (49) to afford the flow of water.

4. Tool according to claim 1, wherein the control with a 360° rotation of the valve body (7) comprises at least two coupling positions, each corresponding to a selected working mode of the tool (1).

5. Tool according to claim 1, wherein each of ports (31, 32, 33) diametrically opposing each other in pairs corresponds to the same function of the tool (1).

6. Tool according to claim 1, wherein the spring (22) is coaxially arranged relative to the longitudinal axis of the casing (2).

7. Tool according to claim 1, wherein the spring (22) is mounted with its upper end at the valve body (7) and with its lower end in an inner part of the casing component (27).

8. Tool according to claim 7, wherein the upper end of the spring (22) is axially and radially mounted on the bottom (20) of the valve body (7).

9. Tool according to claim 8, further comprising a central boss (19) on the bottom (20) of the valve body (7) to accommodate the bearing of the upper end of the spring (22).

10. Tool according to claim 1, further comprising a tubular housing (18) coaxially relative to the longitudinal axis of the casing (2), extending downward from the lower side of the bottom (20) of the valve body (7), radially mounted and wherein the tubular housing (18) can be axially moved in the inner section (27) of the casing (2), accommodating the helically shaped spring (22).

11. Tool according to claim 1, further comprising a casing seat (26) coaxially attached relative to the longitudinal axis of the casing (2) in the inner section (27) of the casing (2) that accommodates the tubular housing (18).

12. Tool according to claim 1, wherein the control is arranged as a connecting link guide to the outer wall (51) of the valve body (7) and to the inner wall (9) of the casing (2).

13. Tool according to claim 12, wherein the connecting link guide comprises on the outer wall (51) of the valve body (7) a profiled groove (52) with oblique profile slots (53) being arranged zigzag, into which engages a finger (57) of at least one sliding screw (55) in the casing wall (2).

14. Tool according to claim 13, wherein the upper and lower profile tips (58, 59), where the profile slots (53) converge, each have a return shape that relative to the inner intersection points of the walls of the profile slots (53) is shifted in the direction of the relative motion of the fingers (57).

15. Tool according to claim 1, wherein cut-outs (42) to accommodate the caps (45) are provided on the lower side of the bottom of the valve body (7), and a cap support (44) with ports (50) to afford the flow of water and ports (45*a*) to accommodate the caps (45), is provided.

* * * * *